US005629589A

United States Patent [19]

Goseberg et al.

[11] Patent Number: 5,629,589

[45] Date of Patent: May 13, 1997

[54] SPLIT-CONFIGURATION HIGH-VOLTAGE DIODE TRANSFORMER FOR A TV RECEIVER

[75] Inventors: Walter Goseberg, Hanover; Wolfgang Reichow, Garbsen; Hans-Werner Sander; Rolf Heidrich, both of Hanover, all of Germany

[73] Assignee: Deutsche Thomson-Brandt GmbH, Villingen-Schwenningen, Germany

[21] Appl. No.: 200,603

[22] Filed: Feb. 23, 1994

Related U.S. Application Data

[63] Continuation of PCT/EP92/01844 Aug. 13, 1992

[30] Foreign Application Priority Data

Aug. 22, 1991 [DE] Germany ..... 41 27 836.4
Sep. 9, 1991 [DE] Germany ..... 41 29 678.8

[51] Int. Cl.[6] ..... H01J 29/70

[52] U.S. Cl. ..... 315/411; 336/185

[58] Field of Search ..... 315/411; 336/185; 363/126; 335/213

[56] References Cited

U.S. PATENT DOCUMENTS

| | | | |
|---|---|---|---|
| 3,904,928 | 9/1975 | Sawada et al. | 315/410 |
| 4,039,924 | 8/1977 | Scales et al. | 315/411 |
| 4,406,978 | 9/1983 | Goseberg et al. . | |
| 4,638,282 | 1/1987 | Ellison | 336/185 |
| 4,862,130 | 8/1989 | Ellison | 336/185 |

FOREIGN PATENT DOCUMENTS

| | | | |
|---|---|---|---|
| 0033450 | 1/1981 | European Pat. Off. . | |
| 0201335 | 5/1986 | European Pat. Off. | H04N 3/195 |
| 3810314 | 10/1989 | Germany | H04N 3/19 |
| 2030784 | 4/1980 | United Kingdom | H01F 15/10 |
| WO92/10906 | 6/1992 | WIPO | H04N 3/195 |

*Primary Examiner*—Theodore M. Blum
*Attorney, Agent, or Firm*—J. S. Tripoli; E. P. Herrmann; D. E. Sragow

[57] ABSTRACT

A diode-split high voltage transformer for a television receiver includes a coil form having a plurality of axially aligned cells. The cells are arranged in groups and are separated by fins. Partial windings are individually arranged in the cells. A plurality of diodes is arranged about the edge of each fin and and substantially normal to the of the form. The partial windings and the diodes are alternately connected in series. Each of the fins includs a ramp-shaped recess tangentially extending from the fin edge to the bottom of the cell adjacent to the fin to provide space allowing the winding wires to stay clear of the partial windings.

11 Claims, 4 Drawing Sheets

SPLIT-CONFIGURATION HIGH-VOLTAGE DIODE TRANSFORMER FOR A TV RECEIVER

This is a continuation of PCT application PCT/EP 92/01844, filed Aug. 13, 1992 by Walter Goseberg, Wolfgang Reichow, Hans-Werner Sanders and Rolf Heidrich and tiled "Split-Configuration High Voltage Diode Transformer For A TV Receiver".

The invention is directed to a diode-split high voltage transformer. Such a transformer contains a number of partial windings located in cells of a coil form. Approximately the same number of diodes are electrically connected to the windings and are physically arranged on the outer edge of the coil form. Because both the cells and the diodes require space in the axial direction of the coil form, there results, especially in the case of a multiplicity of partial windings and diodes, a correspondingly long coil form which increases the amount of space required and reduces the coupling of the coils.

It is an object of the invention to be able to accommodate a number of diodes without the overall axial length of the coil form being increased by any significant amount.

A high voltage transformer having a high voltage winding in a cellular coil form, in which two series connected diodes which, from a circuit point of view, represent a diode located between two partial windings, are located on the outer wall of a cell wall, is described in EP-A-0 033 450. A series connection of two diodes is used because a single diode is unable to withstand the high pulse voltage in the high voltage winding.

A high voltage transformer is described in EP-A-0 201 335, in which a plurality of diodes, that are relatively displaced in the axial direction, are arranged on the outer edge of a cellular coil form. The diodes run at an angle to the peripheral direction of the coil form and thus they each extend in the axial direction of the coil form. Due to this arrangement, the layout for the automatic manufacture of the coil form is simplified and, in particular, the radial separation of the terminal wires of the relatively long diodes from the coil form is reduced.

With the invention, the diodes are arranged around the periphery of the coil form without any offset in the axial direction. If, for example, four diodes are arranged on the outer edge of a cell wall, then the space requirement for the diodes in the axial direction is only one quarter of the space requirement in the known structures where, in each case, only one diode is located on a cell wall. Since the total space requirement for the diodes in the axial direction is reduced, the overall length of the coil form is also reduced. Thus, increased coupling between the primary winding and the secondary winding is realized.

According to a further development of the invention, each cell wall is provided with a ramp-shaped recess running tangentially from its outer edge to the cell base without completely interrupting the cell wall; the winding wire is guided through the recess from a diode terminal, or a point of support, to the cell base. This means that the winding wire places itself in the ramp-shaped recess and becomes spatially separated from the winding located in the cell. Thereby, in particular at the upper winding edge, a gap is created between the winding wire and the winding of the cell which already exhibits, in relation to the winding wire, a considerable voltage. In this way, the electric strength of the winding can be raised.

While, for example, four diodes are located on a circumference along a cell wall, the associated partial windings must of course be located in cells which are arranged following each other in the axial direction of the coil former. Because electrically a diode is located between two partial windings, when winding the partial windings in successive cells, the winding wire must be fed back to each diode. With the invention, the winding is carried out by winding cells successively in the axial direction of the coil form in a sequence such that the conducting wire from a diode or from a point of support, to a cell crosses over only those cells which have already been wound. With this technique, the partial windings of some cells are axially separated from the associated diode. However, this method creates a winding procedure which permits automatic winding, as in the prior art devices. Therefore, depending on the number of cells located between two groups of diodes in the axial direction of the coil form, it can be advantageous to wind some groups of cells successively in a one axial direction and other groups of cells in the other axial direction so that the conducting wires only axially cross cells which have already been wound.

The invention will be explained with reference to the drawing in which.

Figure 5:
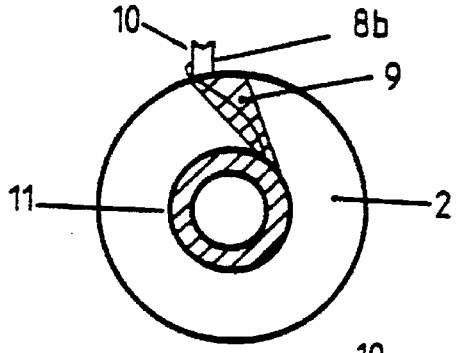
FIG. 5 is a top view of FIG. 4.
Figure 5A:
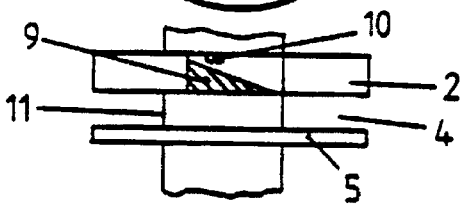
Figure 6:
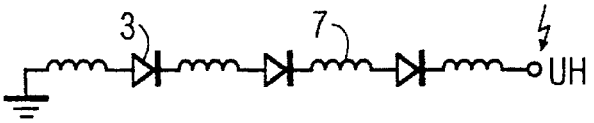

FIG. 5*a* is a side view of FIG. 5;

FIG. 6 shows the equivalent circuit of the partial windingsand diodes

Figure 6A:
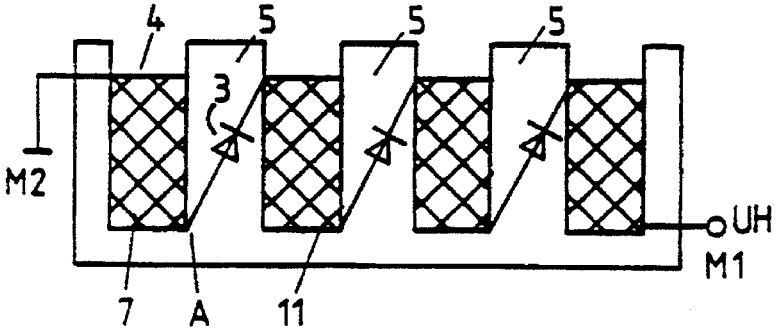
Figure 7:
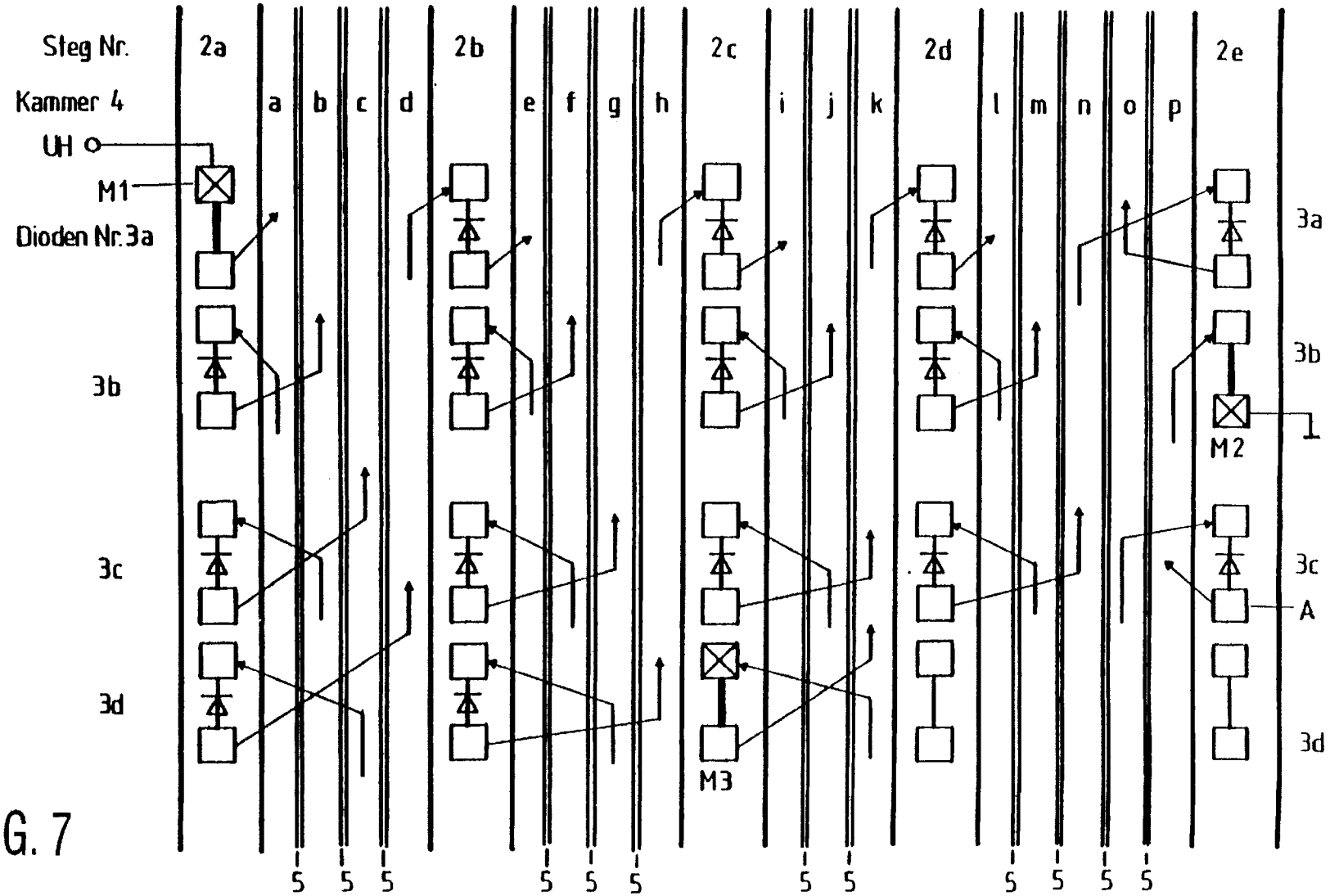
Figure 8:
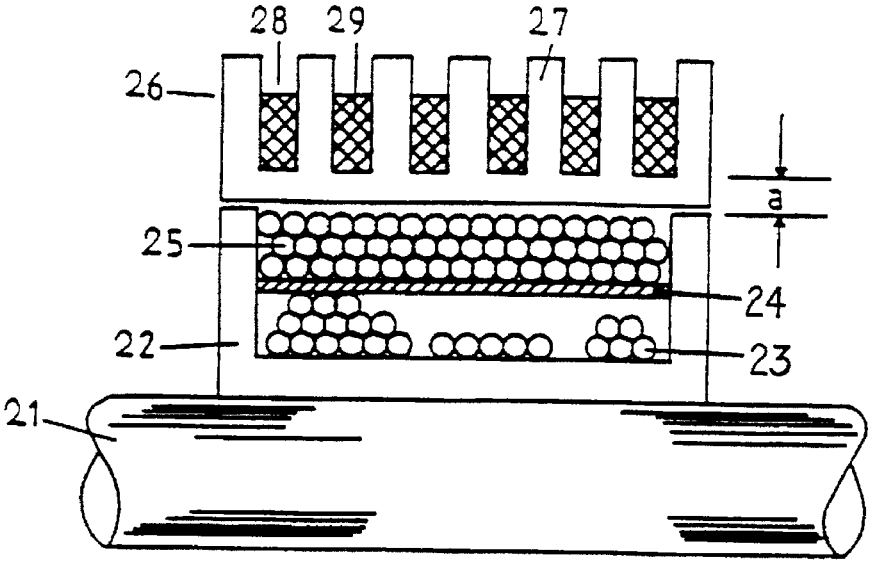
Figure 9:
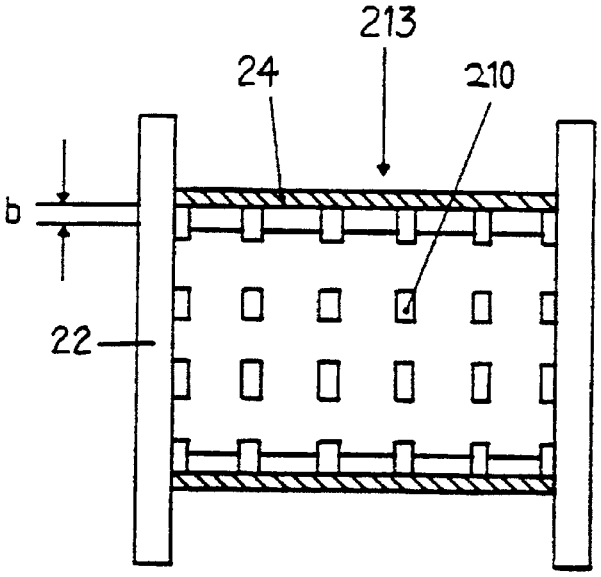

FIG. 6*a* shows the physical layout of the partial windings in the cells and the diodes;

FIG. 7 shows the winding scheme for a winding procedure according to the invention;

FIG. 8 is a preferred embodiment of the coil form;

FIG. 9 is another preferred embodiment of the coil form; and

Figure 10:
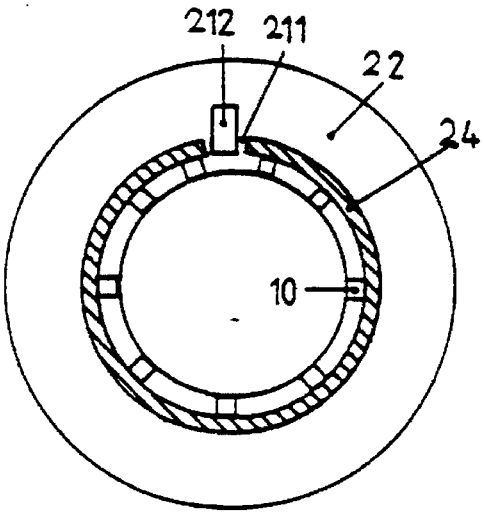

FIG. 10 is another preferred embodiment of the coil form.

Figure 1:
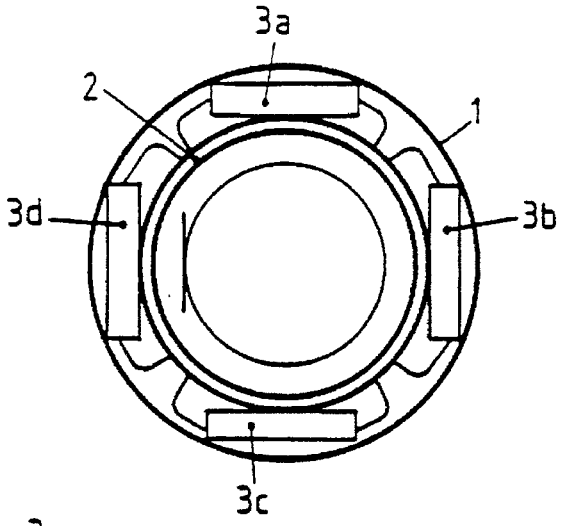
FIG. 1 shows the arrangement of several diodes around the perimeter of the coil form.
Figure 2:
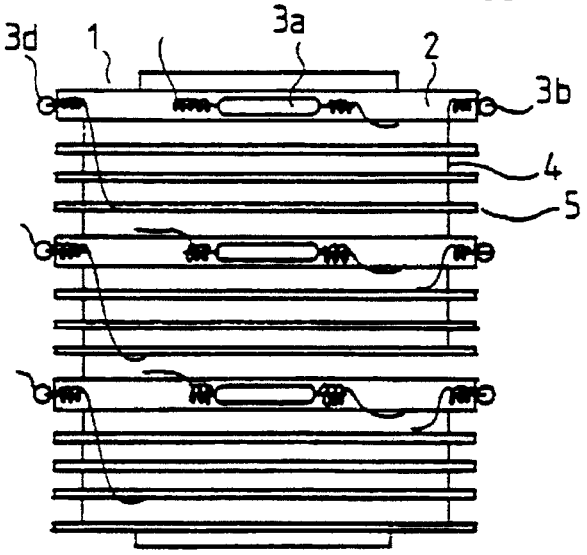
FIG. 2 is another view of the arrangement shown in FIG. 1.

FIGS. 1 and 2 show a coil form having cells for supporting a multiplicity of partial windings of a high voltage transformer. Four high voltage rectifier diodes 3*a*, 3*b*, 3*c*, 3*d*, which are connected to the partial windings in the cells, are arranged distributed around the outer edge of a fin 2.

In FIG. 2 a total of three groups of diodes each consisting of four diodes 3*a* through 3*d* are distributed around the perimeters of fins 2. Between each pair of diode groups are four cells 4 in which the partial windings to be connected to the diodes are subsequently arranged. The cells 4 are separated from one another by cell walls 5. The fins 2 have a thickness of approximately 2 mm, primarily to accomodate the diameter of the diodes 3. The cell walls are approximately 1 mm thick because they only serve to form the cells 4 and to attain the high voltage electric strength. The connecting wires of the diodes 3 are fitted into form-fit catch means on the outer edge of each fin 2. The ends of the windings are wound around the connecting wires of the diodes 3 whereby the connecting wires serve as points of support for the thin winding wires.

Figure 3:
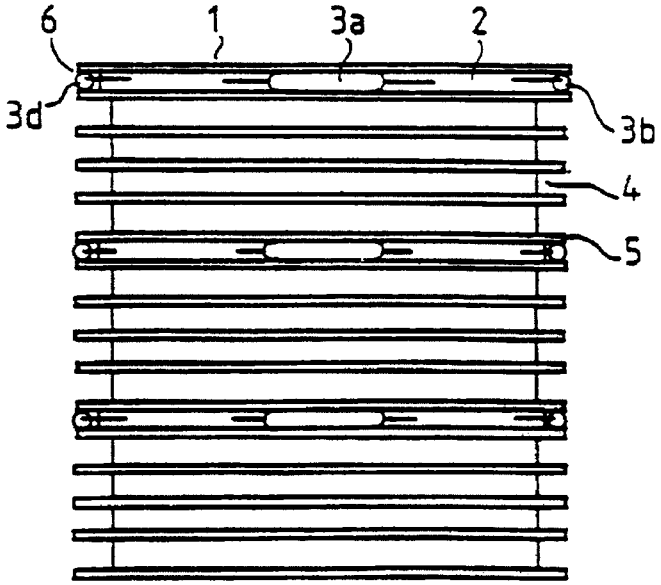
FIG. 3 is another preferred embodiment similar to FIG. 2.

FIG. 3 differs from FIG. 2 in that the diodes 3 are not supported on the outer edge of the fin 2 but, rather, are incorporated in a circumferential groove 6 on the outer edge of the fin 2. This improvement does not cause the external diameter of the inventive transformer to be increased by the diodes 3.

Figure 4:
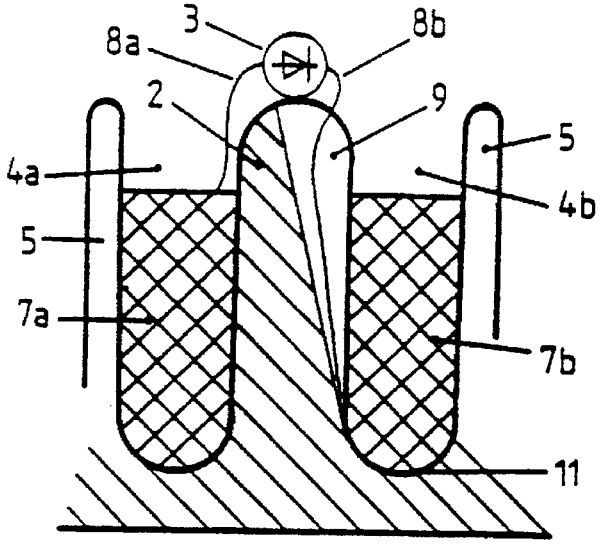
FIG. 4 is a preferred embodiment of the invention.

FIG. 4 showed two cells 4*a* and 4*b* with partial windings 7*a* and 7*b*. The winding wire 8*a* emerging from the partial winding 7*a* at the upper edge of the cell 4*a* is connected to a terminal of the diode 3. The winding wire 8*b* of the partial winding 7*b* in cell 4*b* is connected to the other terminal of the diode 3. The fin 2 between cells 4*a* and 4*b* is provided with a ramp-shaped recess 9 which starts at the upper edge of the fin 2 and extends tangentially towards the cell base 11. The recess 9 is so dimensioned that the fin 2 is not completely interrupted. It can be seen that the winding wire 8*b* places itself into the recess 9 and is thus separated from the winding 7*b*. This is particularly advantageous in the upper region of the winding 7*b* because here the winding, in relation to the winding wire 8*b*, already conducts the full impulse voltage of the winding 7*b*. Despite the recess 9, the fin 2 maintains its insulation effect between cells 4*a* and 4*b*. In particular it is ensured that despite the recess 9, no direct connection between cells 4*a* and 4*b* exists, i.e. windings 7*a* and 7*b* cannot "see each other directly". The ramp-shaped recess 9 is also provided in the cell walls 5 in order to separate the wire leading to the cell base from the winding located in the cell.

In FIGS. 5 and 5*a* the ramp-shaped recess 9 is indicated by the cross-hatched area. At the point on the outer edge of the fin 2 or the cell wall 5 where the ramp-shaped recess 9 starts, a lug 10 is provided on the fin 2 or the cell wall 5. The projection 10 serves as a change-of-direction point for the winding wire 8*b* and ensures that the winding wire 8*b* is placed into the recess 9.

FIG. 6 shows the electrical connection of the diodes 3 and the partial windings 7. FIG. 6*a* shows the physical arrangement of the windings 7 in the cells 4. Each winding wire from the cell base 11 is connected to the anode of the diode and each winding wire from the uppermost layer in the cell 4 is connected to the cathode of the diode 3. The high voltage terminal M1 which receives the high voltage UH for the kinescope is picked up from the cell base of the last partial winding 7. The uppermost layer of the first partial winding 7 is connected to ground, represented by the point of support M2.

FIG. 7 shows a winding scheme for a coil form having five group cells. Two groups 2*a* and 2*b* contain 4 cells, two groups 2*c* and 2*d* contain three cells, and one group 2*e* has two cells. The winding is to produce connections between the diodes 3 and the partial windings 7, as illustrated in FIG. 6. The squares on the electrodes of the diodes indicate the two connecting wires of the diodes, or the points of support to which the winding wires are fed. Five wide fins 2*a* through 2*e* are illustrated. Fins 2*a*, 2*c* and 2*d* support 3 diodes, fin 2*b* supports 4 diodes and fin 2*e* supports 2 diodes. The cells 4*a* through 4*p* formed by the cell walls 5 are incorporated between the fins 2*a* through 2*e* and the cells are filled, either partly or completely, with a partial winding 7. The winding starts at the point of support connected to M1 and is fed to the bottom of cell 4*a*. The winding wire from the top of winding in cell 4*a* is connected to the cathode of diode 3*b* on fin 2*a*. The winding wire from the anode of diode 3*b* is fed to the bottom of cell 4*b*, and the winding wire from the top layer of the winding in cell 4*b* is connected to the cathode of diode 3*c*, the anode of which is connected to the bottom of the winding in cell 4*c*. The top of the winding in cell 4*c* connects to the cathode of diode 3*d* the anode of which connects to the cathode of diode 3*a* on fin 2*b*. The cells 4*a* through 4*p* are wound in this way, whereby the partial windings are connected to the connecting wires of the diodes 3 at the same time. It can be seen that the connecting wires respectively from one terminal of a diode 3 to the corresponding cell are always only laid over those cells which have already been wound. Thus, an automatic winding procedure is rendered possible although the connecting wires between each diode and the winding of the associated cell extend in the axial direction of the coil form over several cells.

In cell 4*k* it is indicated that the winding wire enters and exits cell 4*k* twice. Thereby, a pick-off within a winding for the generation of the focusing voltage is indicated. The focusing voltage can be picked up at point of support M3 which is not connected to any diode 3. The winding of cell 41 begins, at first, exactly like the winding cells 4*a*, 4*e*, 4*i*. The winding wire which emerges later from the cell 4*m* is firstly fixed to the cathode of diode 3*c* on fin 2*d*, and the winding procedure at this diode is discontinued. This is based on the fact that otherwise, owing to the, in total, five cells 41 through 4*p* between fins 2*d* and 2*e*, the requirement that the feeding back of the wires only over cells which have already been wound can no longer be maintained. The winding procedure is instead continued from the right-hand end of the coil form. The winding starts at 'A' at the base of cell 4*p*. Point 'A' corresponds to the corresponding point 'A' in FIG. 6. The winding wire emerging from the top of the coil 7 in cell 4*p* is fed to one end of the point of support M2, which is grounded as shown to FIG. 6. The winding in cell 4*p* is thus concluded, for the time being. Next, the winding wire is fed from the anode of diode 3*a* on fin 2*e* to the bottom of cell 4*o* and from the top of the coil to the cathode of diode 3*c* on fin 2*e*. Thereby, this winding procedure is also concluded. Subsequently, the winding wire from the anode of diode 3*c* on fin 2*d* is fed into the cell 4*n* and exits from the uppermost layer to cathode of diode 3*a* on fine 2*e*. That is now possible because cells 4*o* and 4*p* have already been wound in the previous winding procedures as described.

It can be seen that some points of support like M1, M2 and M3 are not provided with a diode. One terminal serves to physically fix the end of the winding wire and the terminal connected thereto serves for soldering on the winding wire to high voltage UH or to ground. This solution has the advantage that when soldering the wire onto one end of the support point, the 4 soldered joint at the other end of the support point can not be damaged.

The sequence in which, according to FIG. 7, individual groups of cells 4 are wound and connected to the appropriate diodes is almost random. The only requirement which must be observed is that the winding wires must cross over only cells which have already been wound. This is so because otherwise it could not be possible to wind these cells.

With the inventive transformer several auxiliary windings, for example, for heating the kinescope, additional operating voltages or flyback pulses, can be wound onto the coil form first, then, on top of those windings, the primary winding and, over that, the high voltage winding of the transformer. The auxiliary windings typically have different numbers of windings, different numbers of layers and different wire diameters. The auxiliary windings thus have different heights with respect to the base of the coil form and also spaces between the individual windings. This results in a very irregular progression on the upper side of the windings. Therefore, it naturally ensues that any winding which is wound over such windings also has an irregular surface. The secondary high voltage winding can not be wound directly over the primary winding. For reasons of the high voltage electric insulation, an additional coil form over the primary winding is needed to separate the primary and secondary windings. The irregular surface of the primary winding therefore results in impaired coupling between primary and secondary winding, because of the variations in the spacing between the windings.

Through a further development of the invention, as shown in FIGS. 8 through 10, the task is solved of fabricating the coil form so that, despite irregularites in the surface of the auxiliary windings, the coupling between the primary winding and the secondary winding is not impaired.

In this solution, therefore, the irregular build-up of the auxiliary windings with different heights and spaces is deliberately left unchanged. Instead, a sleeve acting as an intermediate bottom is inserted above the auxiliary windings which now forms a defined, smooth base for winding the primary winding yet to be wound, without bumps and depressions. It is then possible, using this newly created, smooth foundation without irregularities, to wind on the primary winding in successive layers "cleanly" so that the upper edge of the primary winding also has a cleanly defined progression without interruptions. Thereby, a defined, minimum gap between the primary winding and the high voltage winding can be maintained, said gap being necessary for achieving the high voltage electric strength.

Use of the sleeve means that the coupling between the primary winding and the auxiliary windings is slightly reduced. However, this does not result in a disadvantage because this coupling is, relatively speaking, not critical.

FIG. 8 shows a simplified representation of a high voltage transformer with a core 21 upon which a coil form 22 is arranged. At the base of the coil form 22 several auxiliary windings 23 with different numbers of windings, different numbers of layers and different wire diameters are wound. An irregular surface is thus formed by the windings 23. A sleeve 24 surrounding the windings 23 is inserted above the auxiliary windings 23, the sleeve can be made from synthetic material and have a wall thickness of 0.20 to 0.60 mm. The primary winding 25 with three layers is wound as a "clean" winding onto the sleeve 24. The defined, smooth foundation formed by the sleeve 24 creates the prerequisite for a smooth surface of the winding 25 without highs or lows.

The coil form 22 is surrounded by the coil form 26. the coil form 26 is constructed as a cell coil form having a multiplicity of cells 28 formed by cell walls 27. The partial windings 29 of the secondary winding (high voltage winding) are located in the cells 28. the partial windings 29 are connected via high voltage rectifier diodes according to the principle of the diode split transformer shown in FIGS. 6 and 6*a*.

In FIG. 9 the coil form 22 is provided with a multiplicity of nipples 210 on its surface which are distributed more or less evenly across the perimeter and the axial length. The height of the nipples 210 above the base of the coil form 22 is slightly greater than the maximum height of the auxiliary windings 23. the nipples 210 form support points for the sleeve 24 and have the effect that the sleeve 24 is held at a defined distance from the cell base over the entire perimeter and entire length of the coil form 22, and that it is not dented by the auxiliary windings 23 or the primary winding 25. The nipples 210 also serve for fixing the wires for the auxiliary windings 23 in the axial direction. The gaps between the nipples 210 serve for feeding back wires of the auxiliary windings 23 always to one end of the coil form 22. This multitude of nipples 210 distributed over the perimeter and length means that a relatively thin material of approximately 0.2 to 0.6 mm can be used for the sleeve 24.

In accordance with FIG. 10, the sleeve is provided with a slit 211 running in the axial direction. Thereby, it is rendered possible that the sleeve 24 can be mounted on the coil support 22 through spreading according to the type of a snap ring in the radial direction or the axial direction 213. The sleeve 24 is built flexibly resilient in the radial direction in such a way that it contacts the upper edges of the nipples 210 automatically. The perimeter of the sleeve 24 is so dimensioned that in the in situ condition, the sleeve does not close completely but forms a slit 211 between its ends. The coil form 22 is provided with a dog 212 which engages the slit 211 after mounting radially or axially. Thereby, the sleeve 24 is prevented from rotating relative to the coil form 22.

The entire assembly shown in FIGS. 8, 9 and 10 without the core is bedded in a sealing compound in a known manner. In doing this, additional fixing and positioning of the sleeve 24 is guaranteed. The diameter of the wires in the primary winding 25 is relatively large, approximately 0.5 to 1 mm. Therefore, it can be advisable to use stranded conductor as winding wire for the primary winding 25 and, if applicable, for the auxiliary windings 23. Stranded conductor is known to be considerably more supple than massive copper wire so that the automatic winding procedure is made easier and , if applicable, the available winding space is even better utilized than with a massive copper wire.

What is claimed is:

1. Diode-split high voltage transformer for a television receiver with a plurality of partial windings each located in a cell of a coil form, said cells being axially spaced along said coil form, and a plurality of diodes connected between different partial windings, said diodes being evenly distributed over a cell wall and arranged without any mutual offset in the axial direction.

2. Transformer according to claim 1, in which four diodes are arranged along the perimeter of a cell wall.

3. Transformer according to claim 1, in which the diodes are located on the outer edge of a cell wall or in a circumferential groove on the outer edge of a cell wall.

4. Transformer according to claim 1, in which a cell wall on which said diodes are located has a greater axial thickness than a cell wall not associated with a diode.

5. Transformer according to claim 1, in which the diodes and their connecting wires are mounted on the cell wall by interlocking retaining means.

6. Transformer according to claim 5, in which the connecting wires serve as points of support for fixing the ends of the wires of the partial windings.

7. Transformer according to claim 1, in which a cell wall comprises a ramp-shaped recess running tangentially from its outer edge to the base of the cell without completely interrupting the cell wall, and the winding wire is fed through said recess from a diode terminal, or a point of support on the cell edge, to the base of the cell.

8. Transformer according to claim 7, in which on the outer edge of the cell wall at the point where the ramp-shaped recess (9) starts, a projection in the radial direction is provided as a change-of-direction point for the winding wire.

9. Transformer according to claim 1, in which winding wires pass from a diode terminal or a point of support to the base of a cell in the axial direction of the coil form across several wound cells.

10. Transformer according to claim 9, in which the cells next to each other in the axial direction of the coil form are wound in such a sequence that the winding wires from a diode or a point of support to a cell are only laid over those cells which have already been wound.

11. Transformer according to claim 10, in which the direction in the axial direction in which the individual cells are wound in succession is opposite for successive groups of cells.

* * * * *